US006809466B2

(12) United States Patent
Kim et al.

(10) Patent No.: US 6,809,466 B2
(45) Date of Patent: Oct. 26, 2004

(54) CATHODE RAY TUBE WITH STRUCTURE FOR PREVENTING ELECTRON BEAM MIS-LANDING CAUSED BY GEOMAGNETISM

(75) Inventors: Chan-Yong Kim, Incheon (KR); Soon-Cheol Shin, Suwon (KR); Eung-Suk Lee, Seoul (KR); Si-Taeg Sung, Suwon (KR); Il-Hwan Jang, Seoul (KR); Won-Ho Kim, Yongin (KR); Do-Hun Pyun, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 67 days.

(21) Appl. No.: 10/141,083

(22) Filed: May 9, 2002

(65) Prior Publication Data

US 2002/0171350 A1 Nov. 21, 2002

(30) Foreign Application Priority Data

May 18, 2001 (KR) ..... 2001-27251

(51) Int. Cl.[7] ..... H01J 29/80
(52) U.S. Cl. ..... 313/407; 313/402
(58) Field of Search ..... 313/402–408, 313/477 R

(56) References Cited

FOREIGN PATENT DOCUMENTS

JP 05325815 * 12/1993 ..... 313/477 R
JP 411167877 A * 6/1999 ..... H01J/29/02

* cited by examiner

*Primary Examiner*—Joseph Williams
(74) *Attorney, Agent, or Firm*—Robert E. Bushnell, Esq.

(57) ABSTRACT

A cathode ray tube includes a panel having a front screen portion on which a phosphor screen is formed and a panel flange integrally formed on an edge of the front screen portion, a funnel connected to the panel flange, a deflection yoke disposed around the funnel, a neck connected to the funnel, an electron gun disposed in the neck, a color selection apparatus for selecting electron beams emitted from the electron gun and allowing the selected electron beams to land on corresponding phosphors, and an inner shield for shielding geomagnetism, the inner shield mounted on the color selection apparatus. The color selection apparatus includes a mask having a plurality of electron beam-passing apertures, the mask being rectangular and having a longitudinal axis and a lateral axis, a frame for supporting the mask in a tensioned state, and a pair of side shield members mounted on lateral sides of the frame to shield the geomagnetism.

21 Claims, 4 Drawing Sheets

CATHODE RAY TUBE WITH STRUCTURE FOR PREVENTING ELECTRON BEAM MIS-LANDING CAUSED BY GEOMAGNETISM

CLAIM OF PRIORITY

This application makes reference to, incorporates the same herein, and claims all benefits accruing under 35 U.S.C § 119 from an application entitled CATHODE RAY TUBE HAVING MEANS FOR PREVENTING MIS-LANDING OF ELECTRON BEAMS BY EARTH MAGNETISM filed with the Korean Industrial Property Office on May 18, 2001 and there duly assigned Ser. No. 2001-27251.

BACKGROUND OF THE INVENTION

1. Technical Field

The present invention relates to a cathode ray tube (CRT), and more particularly, to a cathode ray tube with a structure for preventing electron beam mis-landing caused by geomagnetism.

2. Related Art

Generally, a cathode ray tube is designed to realize an image by scanning a phosphor screen deposited with red R, green G, and blue B phosphors with electron-beams emitted from an electron gun. The electron beams are deflected by a deflection yoke and landed on desired corresponding phosphors to scan the peripheral portion of the phosphor screen as well as the central portion.

However, when the electron beams are deflected, they are affected by external magnetic fields such as that caused by geomagnetism, which causes the electron beams to land on undesired phosphors. This is called mis-landing, and it deteriorates color purity of the cathode ray tube.

To solve the above problem, a magnetic field shield member such as an inner shield for shielding the electron beams from the geomagnetism can be employed. The inner shield is generally mounted on a color selection apparatus disposed inside the cathode ray tube and includes a shadow mask and a mask frame.

In recent years, a flat, large-sized screen panel has been developed to improve the definition of an image realized at a peripheral portion of a large-sized screen. Accordingly, the color selection apparatus employed to realize colors in the cathode ray tube has also been flattened and increased in size so that it can be properly associated with the flat screen panel.

A color selection apparatus comprises a mask provided with plural electron-beam passing apertures and a frame for supporting the mask applied with a predetermined tension. The frame comprises a pair of U-shaped elastic members and a pair of supporting members coupled to the elastic members, the shadow mask being tensioned and mounted on the supporting members.

Due to the space between the elastic members and the shadow mask, a geomagnetism component can adversely affect the electron beams passing through the apertures. This causes the electron beams to land on undesired phosphors, deteriorating the color purity of the cathode ray tube.

SUMMARY OF THE INVENTION

Therefore, the present invention has been made in an effort to solve the above-described problems. It is an objective of the present invention to provide a cathode ray tube that is designed to minimize affection by the east-west (E-W) geomagnetic component of the geomagnetism thereon, thereby improving the color purity of the cathode ray tube by enhancing the beam landing accuracy.

To achieve the above objectives and others, the present invention provides a cathode ray tube, comprising: a panel having a front screen portion on which a phosphor screen is formed, and a panel flange integrally formed on an edge of the front screen portion; a funnel connected to the panel flange; a deflection yoke disposed around the funnel; a neck connected to the funnel; an electron gun disposed in the neck; a color selection apparatus for selecting electron beams emitted from the electron gun and allowing the selected electron beams to land on corresponding phosphors; and an inner shield for shielding geomagnetism, the inner shield mounted on the color selection apparatus; wherein the color selection apparatus comprises a mask having a plurality of electron beam-passing apertures, the mask being rectangular and having a longitudinal axis and a lateral axis, a frame for supporting the mask in a tensioned state, and a pair of side shield members mounted on lateral sides of the frame to shield the geomagnetism.

Preferably, the side shield members have a magnetic permeability higher than that of the inner shield. The frame comprises a pair of supporting members disposed at a predetermined distance from each other in parallel, and a pair of elastic members fixed on both ends of the supporting members to correspond to the lateral sides of the mask.

Preferably, the side shield members are formed of a material having a magnetic permeability above 400 within a magnetic field having a magnetic flux density of about 0.35 gauss (G).

The side shield members are fixed on the elastic members while blocking a space defined between the mask and the elastic members and further fixed on the supporting members.

To achieve these and other objects in accordance with the principles of the present invention, as embodied and broadly described, the present invention provides a cathode ray tube, comprising: a panel having a front screen portion and a phosphor screen, said panel having a panel flange integrally formed on an edge of the front screen portion; a funnel connected to the panel flange; a deflection yoke disposed around said funnel; a neck connected to said funnel; an electron gun disposed in said neck; a color selection apparatus for selecting electron beams emitted from said electron gun, the selected electron beams landing on phosphors of the phosphor screen; and an inner shield shielding geomagnetism, said inner shield being mounted on said color selection apparatus. The color selection apparatus comprises: a mask forming a plurality of electron beam-passing apertures, said mask being rectangular and having a longitudinal axis and a lateral axis; a frame supporting said mask in a tensioned state; and a pair of side shield members shielding geomagnetism, said side shield members being mounted on lateral sides of said frame.

To achieve these and other objects in accordance with the principles of the present invention, as embodied and broadly described, the present invention provides an apparatus, comprising: an inner shield for shielding geomagnetism; and a color selection unit for selecting electron beams emitted from an electron gun, the selected electron beams landing on phosphors of a phosphor screen, said inner shield being mounted on said color selection unit. The color selection unit comprises a mask forming a plurality of electron beam-passing apertures, a frame for supporting said mask in a tensioned state, and a pair of side shield members shielding geomagnetism, said side shield members being mounted on opposite sides of said frame.

To achieve these and other objects in accordance with the principles of the present invention, as embodied and broadly described, the present invention provides an apparatus, comprising: an inner shield for shielding geomagnetism; a color selection unit for selecting electron beams emitted from an electron gun, the selected electron beams landing on phosphors of a phosphor screen, said inner shield being mounted on said color selection unit. The color selection unit comprises: a mask having a face region forming a plurality of electron beam-passing apertures; a frame for supporting said mask in a tensioned state, said frame having two longitudinal sides opposite each other, said frame having two lateral sides opposite each other, the longitudinal sides being longer than the lateral sides; and a pair of side shield members for shielding geomagnetism, said side shield members being mounted at the lateral sides of said frame.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE PREFERRED EMBODIMENTS

While the present invention will be described more fully hereinafter with reference to the accompanying drawings, in which preferred embodiments of the present invention are shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Illustrative embodiments of the invention are described below. In the interest of clarity, not all features of an actual implementation are described. In the following description, well-known functions or constructions are not described in detail since they would obscure the invention in unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure.

Figure 4:
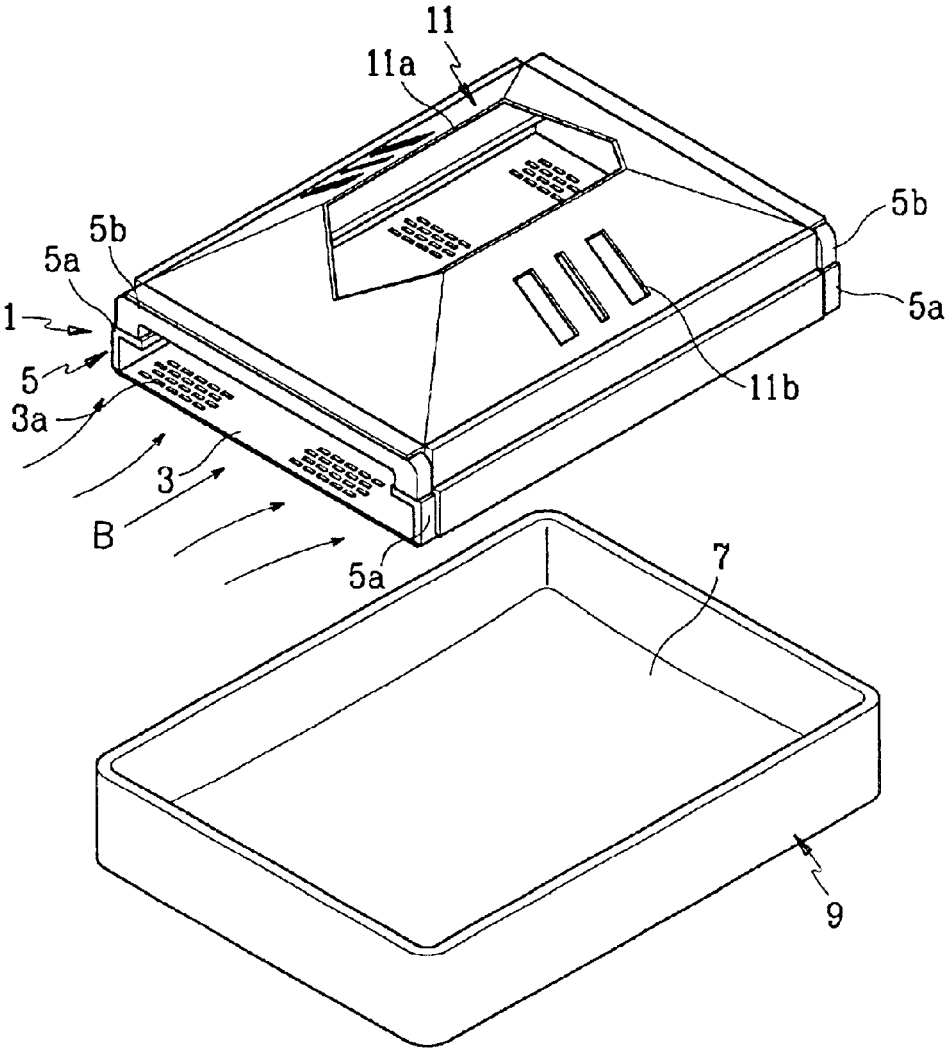
FIG. 4 is an exploded perspective view of a cathode ray tube.

FIG. 4 is an exploded perspective view of a cathode ray tube. As shown in FIG. 4, a color selection apparatus 1 comprises a mask 3 provided with plural electron-beam passing apertures 3*a* and a frame 5 for supporting the mask 3 applied with a predetermined tension. The frame 5 comprises a pair of elastic members 5*b* and a pair of supporting members 5*a* coupled to the elastic members 5*b*, the shadow mask 3 being tensioned and mounted on the supporting members 5*a*.

Such a color selection apparatus is mounted inside a panel 9, on an inner surface of which a phosphor screen 7 is formed. An inner shield 11 is mounted on the supporting members 5*a* and the elastic members 5*b* such that it encloses electron beam emission traces to shield the electron beams from geomagnetism.

Geomagnetism includes a vertical component and a horizontal component. The horizontal component can be classified as a north-south direction component (N-S component) that is parallel to a tube axis and an east-west direction component (E-W component) that is perpendicular to the tube axis. To shield the electron beams from the effects of the horizontal component, a V-shaped notch 11*a* or a piercing portion 11*b* is formed on the inner shield 11.

However, the color selection apparatus 1 in FIG. 4 still has a weakness against the E-W component. That is, to apply tension to the mask, the elastic members 5*b* are designed so as to have a U-shape. This U-shape of the elastic members 5*b* causes a space to be defined by the mask 3 and the elastic members 5*b*. The E-W component is applied to lateral sides of the panel 9 in a longitudinal direction as indicated by "B" arrows in FIG. 4. Therefore, due to the space between the elastic members 5*b* and the shadow mask 3, the E-W component affects the electron beams passing through the apertures. This causes the electron beams to land on undesired phosphors, deteriorating the color purity of the cathode ray tube.

Figure 1:
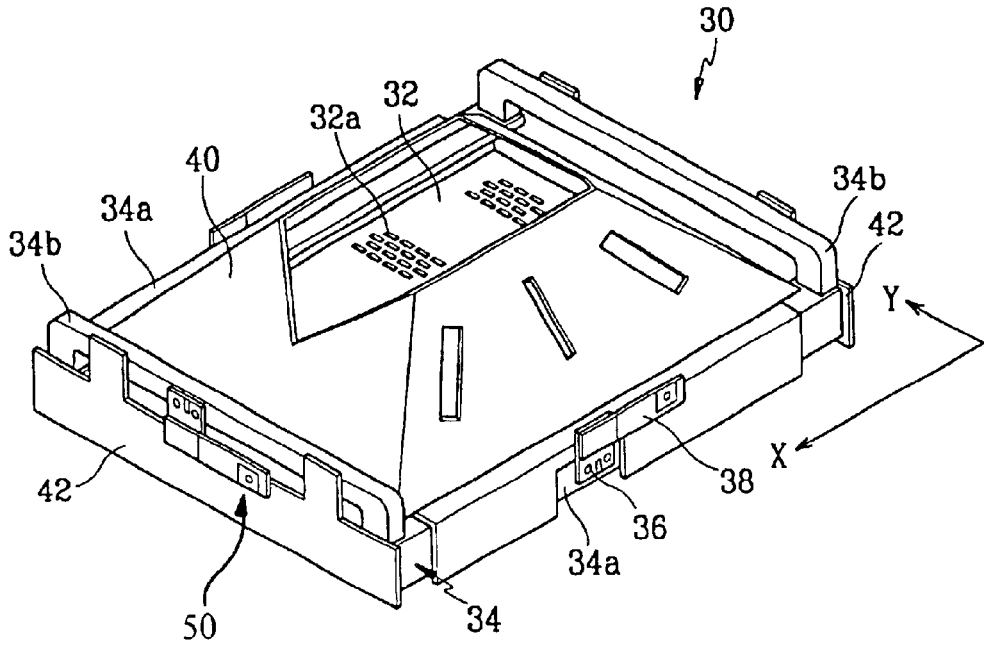
FIG. 1 is a perspective view of a color selection apparatus, in accordance with the principles of the present invention.
Figure 2:
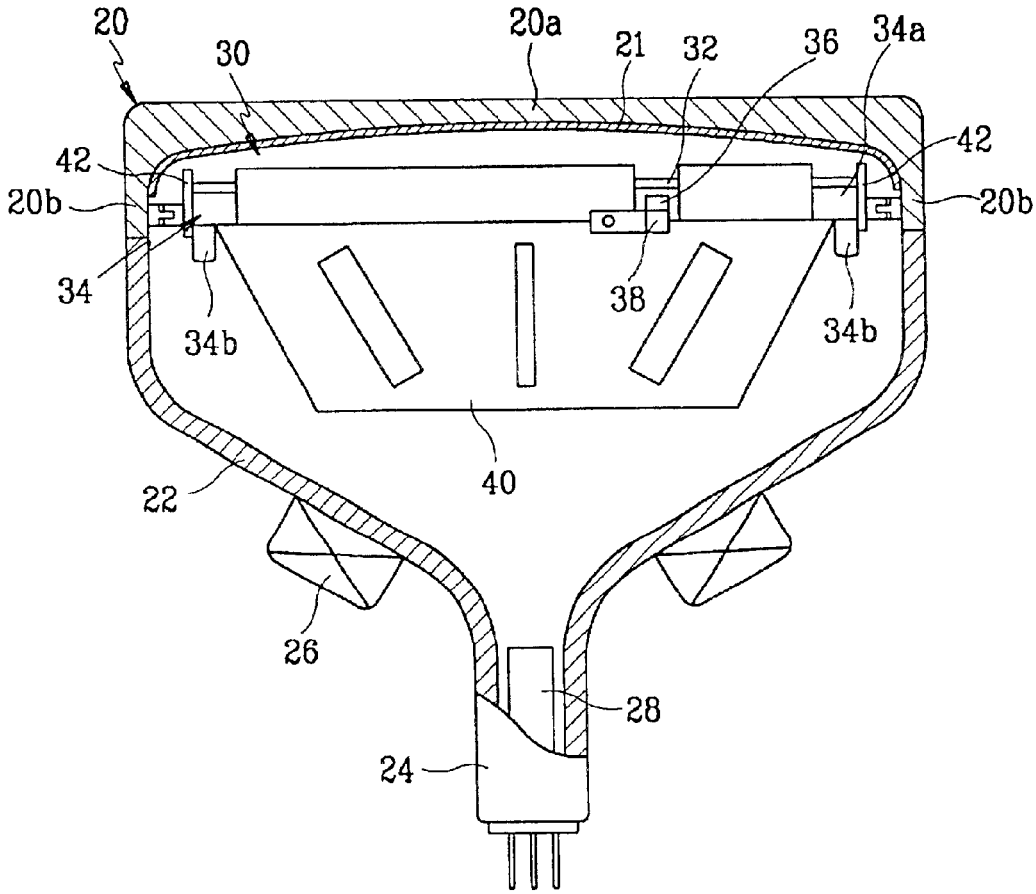
FIG. 2 is a sectional view of a cathode ray tube, in accordance with the principles of the present invention.
Figure 3:
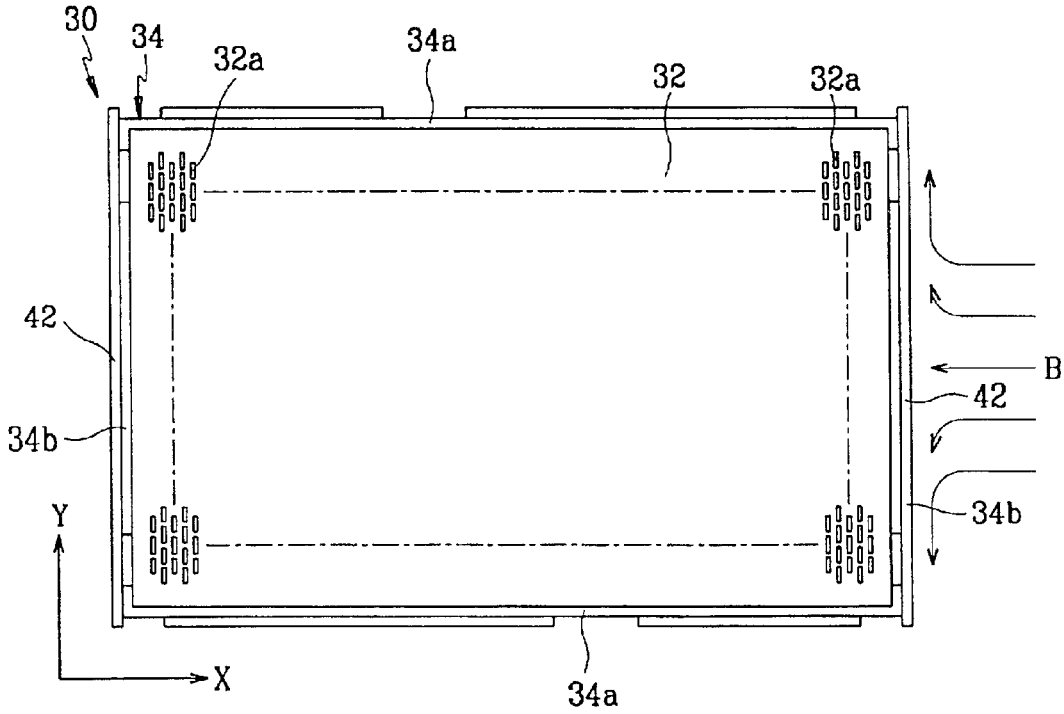
FIG. 3 is a front view of a color selection apparatus, in accordance with the principles of the present invention.

Preferred embodiments of the present invention will be described in detail with reference to the accompanying drawings FIGS. 1–3. FIG. 1 is a perspective view of a color selection apparatus, in accordance with the principles of the present invention. FIG. 2 is a sectional view of a cathode ray tube, in accordance with the principles of the present invention. FIG. 3 is a front view of a color selection apparatus, in accordance with the principles of the present invention. FIGS. 1–3 show a color selection apparatus and a cathode ray tube in accordance with a preferred embodiment of the present invention.

As shown in the FIGS. 1–3, a cathode ray tube comprises a panel 20 having a screen portion 20*a* on an inner surface of which a phosphor screen 21 is formed and on an edge of which a panel flange 20*b* is integrally formed, a funnel 22 connected to the panel 20, and a neck 24 connected to the funnel 22. A deflection yoke 26 is mounted around the funnel 22, and an electron gun 28 for emitting electron beams is mounted in the neck 24.

As stated earlier, the geomagnetism includes a vertical component and a horizontal component. The horizontal component can be classified as having a north-south direction component (N-S component) that is in parallel with a tube axis and an east-west direction component (E-W component) that is perpendicular to the tube axis. With reference to FIG. 2, a tube axis of a cathode ray tube generally extends in a direction from the neck 24 straight up toward the screen portion 20*a*. The E-W component of the horizontal component is indicated by the "B" arrows in FIGS. 3 and 4. With reference to FIG. 2, the N-S component of the horizontal component is not explicitly shown in the drawings, but is oriented to be parallel to the tube axis of a cathode ray tube.

The N-S component is not required to be exactly parallel with the tube axis, of course. The N-S component can be substantially parallel with the tube axis or roughly parallel with the tube axis. Similarly, the E-W component can be substantially perpendicular to the tube axis or roughly perpendicular to the tube axis.

A color selection apparatus 30 is disposed inside the panel 20 so as to select red (R), green (G), and blue (B) electron beams emitted from the electron gun 28. The color selection apparatus 30 can also be referred to as a color selection unit 30. Such a color selection apparatus 30 is designed to employ a tensioned mask 32 provided with a plurality of electron beam passing apertures 32*a*. The tensioned mask 32 is rectangular, having a longitudinal axis X and a lateral axis Y.

The mask 32 is tensioned in a direction of the longitudinal axis X or the lateral axis Y, and is mounted on a frame 34. The frame 34 comprises a pair of supporting members 34*a* disposed at a predetermined distance from each other in parallel, and a pair of elastic members 34*b* fixed on both ends of the supporting members 34*a* to define a rectangular frame with the supporting members 34*a*.

In this embodiment, the mask 32 is tensioned in a direction of the lateral axis Y and welded on the top surfaces of the supporting members 34*a*. Each of the elastic members 34*b* is U-shaped to maintain the tensioned state of the mask. The tension applied to the periphery of the mask 32 is greater than that applied to the center of the mask 32.

The color selection apparatus 30 is disposed inside the panel 20 such that the tensioned mask 32 faces the phosphor screen 21. That is, the color selection apparatus 30 is mounted on the panel flange 20*b* by coupling means including a hook 36 and a spring 38.

The electron beam passing apertures 32*a* are formed on a face region of the mask 32. The supporting members 34*a* and elastic members 34*b* are fixed to side edge regions of the mask 32. Each one of the side shield members 42 can be fixed to a respective elastic member 34*b*. Each one of the side shield members 42 can be fixed to the supporting members 34*a*. The supporting members 34*a* are fixed to the longitudinal side edge regions of the mask 32. The elastic members 34*b* are fixed to the lateral side edge regions of the mask 32. The side shield members 42 are fixed to the frame 34 at the lateral side edge regions of the frame 34.

An inner shield 40 is coupled on a rear side of the color selection apparatus 30. As the inner shield 40 is identical to the inner shield 11 shown in FIG. 4, the detailed description of the inner shield 40 will be omitted herein.

A pair of side shield members 42 for shielding the electron beams from the E-W component of the geomagnetism are mounted on both lateral sides of the frame 34. Each of the side shield members 42 is formed of a thin plate having a thickness of about 0.15–0.3 millimeters (mm). The side shield members 42 are disposed opposing lateral sides of the panel flange 20*b* of the panel 20 when the color selection apparatus 30 is disposed inside the panel 20. The side shield members 42 are mounted on opposite sides of the frame 34. As shown in FIG. 1, the side shield member 42 has a face region 50. The side shield member 42 is formed of a thin plate having the face region 50 and side edge regions, as shown in FIGS. 1–3. As shown in FIG. 1, the supporting members 34*a* extend in a first direction substantially perpendicular to the face region of the mask 32, the elastic members 34*b* extend in a second direction substantially perpendicular to the first direction and substantially parallel to the face region of said mask, and the side shield members 42 extend in the second direction. With reference to FIGS. 1–3, the face region 50 of the side shield member 42 is substantially perpendicular to the face region of the mask 32.

The side shield members 42 are disposed lengthwise on the lateral sides of the frame 34 to block the space defined between the mask 32 and the elastic members 34*b*. Preferably, the side shield members 42 are welded on the elastic members 34*b*, and they are further preferably welded on the supporting members 34*a*.

The side shield members 42 are formed of a material having a magnetic permeability $\mu$ higher than that of the inner shield 40 to enhance their shielding performance. Preferably, the magnetic permeability $\mu$ of the side shield members is above 400 within a magnetic field having a magnetic flux density of about 0.35 gauss (G). Typically, in the meters/kilograms/seconds (MKS) unit system, a unit of magnetic permeability $\mu$ is H/m, but the unit becomes a dimensionless number in the Gaussian system. In the disclosure of the present invention, the value of the magnetic permeability is represented by a dimensionless number. The inner shield 40 is extended to longitudinal sides of the frame 34, which correspond to longitudinal sides of the panel flange 20*b* of the panel 20.

By means of the above described structure of the inventive cathode ray tube, when the E-W component of the geomagnetism is applied in a direction of the longitudinal axis of the panel 20 through the panel flange 20*b*, this component is blocked by the side shield members 42 and flows away along the longitudinal sides of the frame 34, as indicated by the "B" arrows in FIG. 3. While the side shield members 42 block or shield the E-W component of the geomagnetism, the other components of the geomagnetism are blocked by the inner shield 40. Accordingly, the electron beams passing through the color selection apparatus 30 are not affected by the E-W component of the geomagnetism or the N-S component of the geomagnetism, so that the beams land on the desired phosphors.

While the present invention has been illustrated by the description of embodiments thereof, and while the embodiments have been described in considerable detail, it is not the intention of the inventor to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the general inventive concept.

What is claimed is:

1. A cathode ray tube, comprising:

a panel having a front screen portion and a phosphor screen, said panel having a panel flange integrally formed on an edge of the front screen portion;

a funnel connected to the panel flange;

a deflection yoke disposed around said funnel;

a neck connected to said funnel;

an electron gun disposed in said neck;

a color selection apparatus for selecting electron beams emitted from said electron gun, the selected electron beams landing on phosphors of the phosphor screen; and an inner shield for shielding geomagnetism, said inner shield being mounted on said color selection apparatus;

said inner shield having a first magnetic permeability, said side shield members having a second magnetic permeability higher than the first magnetic permeability.

2. The cathode ray tube of claim 1, said color selection apparatus comprising a mask having a plurality of electron beam-passing apertures, said mask being rectangular and having a longitudinal axis and a lateral axis.

3. The cathode ray tube of claim 2, said color selection apparatus further comprising a frame for supporting said mask in a tensioned state.

4. The cathode ray tube of claim 3, said color selection apparatus further comprising a pair of side shield members for shielding geomagnetism, said side shield members being mounted on lateral sides of said frame.

5. The cathode ray tube of claim 2, said inner shield shielding first components of geomagnetism along the longitudinal axis, said pair of side shield members shielding second components of geomagnetism along the lateral axis.

6. A cathode ray tube comprising:

a panel having a front screen portion and a phosphor screen, said panel having a panel flange integrally formed on an edge of the front screen portion;

a funnel connected to the panel flange;

a deflection yoke disposed around said funnel;

a neck connected to said funnel;

an electron gun disposed in said neck;

a color selection apparatus for selecting electron beams emitted from said electron gun, the selected electron beams landing on phosphors of the phosphor screen; and an inner shield for shielding geomagnetism, said inner shield being mounted on said color selection apparatus;

said color selection apparatus comprising a mask having a plurality of electron beam-passing apertures and a frame supporting said mask in a tensioned state, said frame comprising:

a pair of supporting members disposed parallel to each other and at a predetermined distance from each other; and a pair of elastic members fixed on both ends of said supporting members and corresponding to lateral sides of said mask.

7. The cathode ray tube of claim 6, said color selection apparatus further comprising a pair of side shield members for shielding geomagnetism, each one of said side shield members being fixed on a respective one of said elastic members, and blocking a space defined between said mask and the respective one of said elastic members.

8. The cathode ray tube of claim 6, said color selection apparatus further comprising a pair of side shield members for shielding geomagnetism, said side shield members being fixed on said supporting members.

9. A cathode ray tube comprising:

a panel having a front screen portion and a phosphor screen, said panel having a panel flange integrally formed on an edge of the front screen portion;

a funnel connected to the panel flange;

a deflection yoke disposed around said funnel;

a neck connected to said funnel;

an electron gun disposed in said neck;

a color selection apparatus for selecting electron beams emitted from said electron gun, the selected electron beams landing on phosphors of the phosphor screen; and an inner shield for shielding geomagnetism, said inner shield being mounted on said color selection apparatus;

said color selection apparatus comprising a pair of side shield members for shielding geomagnetron, each one of said side shield members being formed of a material having a magnetic permeability above 400 within a magnetic field having a magnetic flux density of approximately 0.35 gauss.

10. An apparatus, comprising:

an inner shield for shielding geomagnetism; and a color selection unit for selecting electron beams emitted from an electron gun, the selected electron beams landing on phosphors of a phosphor screen, said inner shield being mounted on said color selection unit;

said color selection unit comprising a mask having a plurality of electron beam-passing apertures, a frame for supporting said mask in a tensioned state, and a pair of side shield members for shielding geomagnetism, said side shield members being mounted on opposite sides of said frame;

said inner shield having a first magnetic permeability, said side shield members having a second magnetic permeability higher than the first magnetic permeability.

11. The apparatus of claim 10, said inner shield shielding first components of geomagnetism along a first direction, said pair of side shield members shielding second components of geomagnetism along a second direction perpendicular to the first direction.

12. The apparatus of claim 11, said apparatus being mounted to an interior of a cathode ray tube, the first direction being parallel to a tube axis direction of the cathode ray tube.

13. The apparatus of claim 10, said frame comprising:

a pair of supporting members disposed parallel to each other and at a predetermined distance from each other; and a pair of elastic members fixed on ends of said supporting members to form sides of said mask.

14. The apparatus of claim 13, each one of said side shield members being fixed on a respective one of said elastic members, and blocking a space defined between said mask and the respective one of said elastic members.

15. The apparatus of claim 14, said side shield members being fixed on said supporting members.

16. The apparatus of claim 13, said side shield members being fixed on said supporting members.

17. An apparatus, comprising:

a mask having a face region forming a plurality of apertures;

a support member for supporting said mask and extending in a first direction substantially parallel to the face region of said mask;

an elastic member fixed to said support member, said elastic member extending in a second direction substantially perpendicular to the first direction and substantially parallel to the face region of said mask; and a side shield member extending in the second direction and having a face region arranged to be substantially perpendicular to the face region of said mask, said side shield member being fixed to at least one of said support member and said elastic member, said side shield member shielding magnetism.

18. The apparatus of claim 17, said elastic member defining a space between said elastic member and said mask, said side shield member at least partly blocking the space.

19. The apparatus of claim 17, further comprising an inner shield for blocking magnetism and fixed to said support member, said inner shield having a first magnetic permeability, said side shield member having a second magnetic permeability higher than the first magnetic permeability.

20. The apparatus of claim 17, said side shield member being formed of a material having a magnetic permeability above 400 within a magnetic field having a magnetic flux density of approximately 0.35 gauss.

21. The apparatus of claim 17, said apparatus being fixed in a cathode ray tube.

* * * * *